United States Patent [19]

Kruse

[11] Patent Number: 4,548,019

[45] Date of Patent: Oct. 22, 1985

[54] PACKING MACHINE FOR CIGARETTES OR THE LIKE

[75] Inventor: Friedel Kruse, Oststeinbek, Fed. Rep. of Germany

[73] Assignee: Hauni-Werke Körber & Co. KG., Hamburg, Fed. Rep. of Germany

[21] Appl. No.: 557,731

[22] Filed: Dec. 2, 1983

[30] Foreign Application Priority Data

Dec. 8, 1982 [DE] Fed. Rep. of Germany ..... 3245424

[51] Int. Cl.[4] ..... B65B 11/32; B65B 19/24; B65B 49/12

[52] U.S. Cl. ..... 53/170; 53/234; 53/575; 493/164

[58] Field of Search ..... 53/170, 234, 247, 250, 53/252, 575; 493/164

[56] References Cited

U.S. PATENT DOCUMENTS

| | | | |
|---|---|---|---|
| 1,379,254 | 5/1921 | Ekström et al. | 493/164 X |
| 1,885,910 | 11/1932 | Gwinn et al. | 53/575 X |
| 2,770,175 | 11/1956 | Earp | 493/164 X |
| 2,954,655 | 10/1960 | Seragnoli | 53/234 |
| 3,956,870 | 5/1976 | Kruse et al. | 53/55 |

FOREIGN PATENT DOCUMENTS

| | | | |
|---|---|---|---|
| 2163784 | 7/1973 | Fed. Rep. of Germany | 53/324 |

*Primary Examiner*—Robert L. Spruill
*Assistant Examiner*—Michael D. Folkerts
*Attorney, Agent, or Firm*—Peter K. Kontler

[57] ABSTRACT

A packing machine, wherein an indexible turret carries an annulus of hollow mandrels for arrays of cigarettes, has a tongs which delivers a flat blank between two neighboring mandrels during each period of dwell of the turret, and such blank is placed against the front side of the mandrel therebehind, as considered in the direction of movement of the turret. A biasing member is installed between each pair of neighboring mandrels, and the biasing member which is adjacent to a mandrel that is contacted by a freshly supplied blank is thereupon moved against the outer side of the blank to urge it against the front side of the mandrel. The blank is then converted into a U-shaped body overlaying the front side and the lateral surfaces of the respective mandrel while it is held by the adjacent biasing member. The marginal portions of the U-shaped body are thereupon folded over each other at the rear side of the respective mandrel and adhere to each other under the action of adhesive which is applied to the outer marginal portion. The respective biasing member is then shifted forwardly to bear against the outer marginal portion of the blank surrounding the preceding mandrel to prevent separation of the marginal portions before the adhesive sets. The biasing members are moved rearwardly by discrete springs and forwardly by a stationary cam. Electromagnets are provided to hold the biasing members in neutral positions during introduction of fresh blanks between the respective mandrels.

16 Claims, 4 Drawing Figures

PACKING MACHINE FOR CIGARETTES OR THE LIKE

BACKGROUND OF THE INVENTION

The present invention relates to packing machines in general, and more particularly to improvements in packing machines which can be utilized for the making of cigarette packs or the like. Still more particularly, the invention relates to improvements in means for manipulating blanks which are converted into envelopes for blocks or other arrays of articles of the tobacco processing industry. Such articles can include cigarettes, cigarillos, cigars, cheroots and the like.

Commonly owned U.S. Pat. No. 3,956,870 granted May 18, 1976 to Friedel Kruse et al. (the disclosure of this patent is incorporated herein by reference) discloses a cigarette packing machine wherein a first turret-shaped rotary conveyor carries an annulus of equidistant hollow mandrels for blocks of parallel cigarettes and receives such blocks at a first transfer station from a condensing or compacting conveyor which, in turn, receives uncompressed blocks from the pockets of an endless chain conveyor. The first transfer station is followed by a station where a pivotable tongs or another suitable supplying device delivers blanks into the spaces between successive mandrels. The blanks are caused to bear against the front sides of the oncoming mandrels by devices which are disclosed, for example, in commonly owned U.S. Pat. No. 3,750,676 granted Aug. 7, 1973 to Friedel Kruse et al. The thus held blanks are thereupon subjected to the action of suitable draping, folding and tucking instrumentalities which convert each blank into an envelope surrounding all but one (open) side of the respective mandrel. The blocks of cigarettes are expelled from the respective mandrels by pushers which enter by way of the respective open sides, and the blocks strip the respective envelopes off the corresponding mandrels for transfer onto a second conveyor at a second transfer station. The machine which embodies the features of the aforediscussed patented machines is manufactured by the assignee of the present application and is known as COMPAS. The first conveyor is caused to advance stepwise and each mandrel is first draped into a first blank which consists of a metallic foil. The thus obtained first envelope is thereupon confined in a second envelope obtained from a second blank which is draped around the first envelope, i.e., around the respective mandrel, and which can be made of paper, cardboard, synthetic plastic sheet material or the like. The means for holding the freshly supplied first and second blanks against the respective mandrels comprises pivotable holders which are designed to urge the blanks against the front sides of the respective trailing mandrels, as considered in the direction of travel of the turret. Each pivotable holder is movable between a first position in which it is remote from the adjacent mandrels and a second position in which it bears against the freshly supplied blank at the front side of the upstream or trailing mandrel. Each second blank is coated with a suitable adhesive at the locations where its portions are to overlap and adhere to each other, particularly at the rear side of the respective mandrel. This creates problems when the material of the second blanks exhibits a strong tendency to reassume its original shape, i.e., the second envelope opens up, especially at the rear side of the mandrel, and the corresponding pack must be discarded. This is particularly undesirable in modern high-speed packing machines which are designed to turn out very large numbers of packs per unit of time (e.g., 400 packs per minute), i.e., in machines wherein the ejection of a relatively small number of packs per unit of time amounts to pronounced losses in output. Another reason for the opening of seams of second envelopes on packs which are produced in such machines is that the intervals of time which are allotted for setting of the adhesive between overlapping portions of the second blanks are extremely short.

OBJECTS AND SUMMARY OF THE INVENTION

An object of the invention is to provide a novel and improved packing machine which is constructed and assembled in such a way that the adhesive-coated seams between overlapping portions of folded blanks are less likely to open up than in heretofore known packing machines.

Another object of the invention is to provide a packing machine wherein the envelopes consisting of deformed blanks are not likely to open up even if the intervals for setting of the adhesive are very short or even extremely short, and even if the material of the blanks exhibits a pronounced tendency to reassume its original shape.

A further object of the invention is to provide a packing machine wherein the aforediscussed objects are accomplished in a surprisingly simple and inexpensive way.

An additional object of the invention is to provide novel and improved means for holding the blanks in requisite engagement with the mandrels in a cigarette packing machine of the above outlined character.

Still another object of the invention is to provide the packing machine with novel and improved means for actuating the holding means for blanks of wrapping material.

A further object of the invention is to provide a novel and improved method of preventing freshly formed envelopes of cigarette packs from opening up in the regions where portions of such envelopes overlap and are bonded to each other by a wet adhesive or by a hotmelt.

Another object of the invention is to provide a packing machine wherein the number of rejects which are attributable to unsatisfactory envelopes for arrays of rod-shaped smokers' products is a small fraction of the number of rejects in heretofore known packing machines.

An additional object of the invention is to provide a packing machine which can effectively prevent the opening of envelopes for arrays of rod-shaped smokers' products irrespective of the speed at which the packs are turned out and at least substantially independently of the nature of material which is chosen for the making of envelopes.

The invention resides in the provision of a packing machine for arrays of cigarettes or other articles of the tobacco processing industry. The machine comprises a conveyor having a series of spaced-apart hollow mandrels which are caused to advance in a predetermined direction along an endless path and each such mandrel has a front side and a rear side, as considered in the predetermined direction, means for introducing arrays of articles into successive mandrels in a first portion of the path, a source (e.g., a magazine) of foldable blanks (such blanks can be made of paper, cardboard or a synthetic plastic material), means for supplying blanks from the source into the spaces between successive mandrels in a second portion of the path downstream of the first portion, means for draping the thus supplied blanks about the mandrels which follow the supplied blanks, as considered in the predetermined direction, so that each draped blank includes a pair of overlapping marginal portions at the rear side of the respective mandrel, and means for holding the blanks against the mandrels. The holding means includes biasing members which are disposed in the spaces between successive mandrels of the series and share the movement of the conveyor, means for moving successive biasing members against the freshly supplied blanks at the front sides of the mandrels immediately behind the respective biasing members in a third portion of the path downstream of the second portion, and means for shifting successive biasing members against the overlapping marginal portions of draped blanks at the rear sides of the preceding mandrels, as considered in the predetermined direction, in a fourth portion of the path downstream of the third portion.

Each of the mandrels further comprises lateral surfaces which extend between the respective front and rear sides, and the draping means preferably comprises first folding means for folding the blanks first around the lateral surfaces of the respective mandrels and second folding means for thereupon folding the marginal portions of the blanks over the rear sides of the respective mandrels.

Each holding means can further comprise a lever for each of the biasing members. The levers are pivotally mounted on the conveyor, and the moving and shifting means are then designed to respectively move and shift the biasing members through the medium of the respective levers. The moving means can comprise resilient means for yieldably urging the biasing members toward the front sides of the neighboring mandrels, and the packing machine preferably further comprises distancing means (preferably a discrete electromagnet for each biasing member) for maintaining the biasing members out of contact with the front sides of the adjacent upstream mandrels in the second portion of the path to allow for unimpeded delivery of fresh blanks between the biasing members and the front sides of the adjacent mandrels. The distancing means is preferably designed to maintain the biasing members out of contact with the front sides of the adjacent upstream mandrels as well as out of contact with the rear sides of the adjacent downstream mandrels while the mandrels advance along the second portion of the path. The first folding means is preferably designed to fold the blanks over the lateral surfaces of the respective mandrels in or immediately downstream of the third portion of the path, and the second folding means is preferably designed to fold the marginal portions of the blanks over the rear sides of the respective mandrels between the third and fourth portions of the path, i.e., before the biasing members are caused to engage the folded-over overlapping marginal portions.

One of the moving and shifting means can comprise a stationary cam, and the aforementioned levers are then provided with follower means to track the stationary cam. In accordance with a presently preferred embodiment of the packing machine, each lever comprises a first arm which carries the respective biasing member and a second arm which is provided with the respective follower means (e.g., with a roller follower). Each lever can constitute a bell crank lever. The cam preferably includes a first section which serves to maintain the biasing members in engagement with the folded marginal portions of blanks at the rear sides of the respective mandrels in the fourth portion of the path, and a second section which is movable between first and second positions in the region between the third and fourth portions of the path to thereby shift successive biasing members from engagement with the blanks at the front sides of the adjacent upstream mandrels into engagement with the overlapping marginal portions of blanks at the rear sides of the adjacent downstream mandrels, as considered in the predetermined direction. The conveyor preferably comprises or constitutes a turret which is rotatable about a predetermined axis, and the first section of the stationary cam preferably extends along an arc with the center of curvature on the axis of the turret. The second section of the cam preferably also extends along an arc and has a radius of curvature matching the radius of curvature of the first section. The center of curvature of the second section of the cam is preferably moved onto the axis of the turret while the second section of the cam moves to its second position to thereby shift the adjacent biasing member into engagement with the overlapping marginal portions of a folded blank. The drive means for moving (preferably pivoting) the second section of the cam between its first and second positions can comprise a rotary cam (e.g., a disc cam) and such rotary cam can receive torque at requisite intervals from the motor means which drives the conveyor, e.g., from the main prime mover of the packing machine.

The packing machine further comprises means for coating selected portions of the blanks with adhesive intermediate the source and the second portion of the path. Such selected portions include one of the marginal portions of each blank.

Still further, the packing machine can comprise a second source of different second blanks (e.g., a bobbin containing a supply of metallic foil and means for severing second blanks from the leading end of the foil), means for supplying second blanks from the respective source into the spaces between successive mandrels in a fifth portion of the path upstream of the second portion, and means for draping the second blanks about the mandrels which are located behind the second blanks while such mandrels are caused to move along a sixth portion of the path between the fifth and second portions.

The novel features which are considered as characteristic of the invention are set forth in particular in the appended claims. The improved packing machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1A:
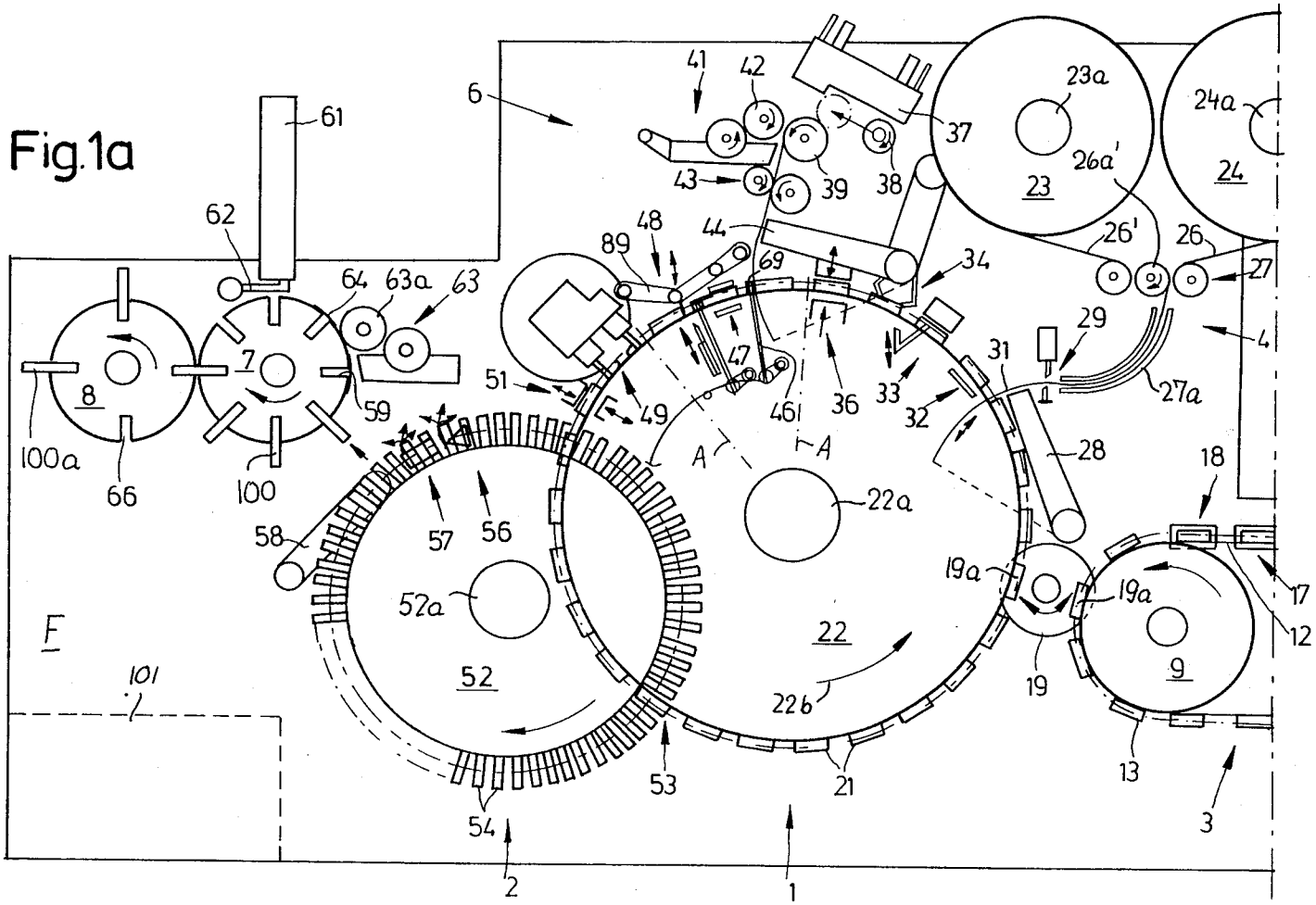
FIG. 1 (composed of FIGS. 1*a* and 1*b*) is a schematic elevational view of a cigarette packing machine which embodies the invention.
Figure 1B:
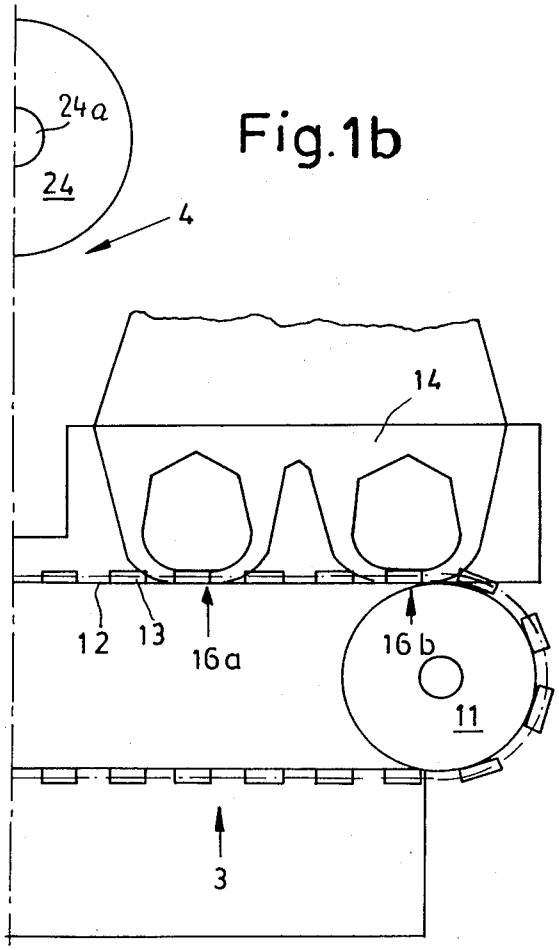

Referring first to FIGS. 1*a* and 1*b*, there is shown a cigarette packing machine which comprises the following components: a first indexible conveyor 1 which includes a rotary turret 22 mounted on and rotatable about the fixed axis of a horizontal shaft 22*a* mounted in the machine frame F; a second indexible conveyor 2 including a rotary turret 52 mounted on and rotatable about the horizontal axis of a shaft 52*a* which is installed in the frame F in such a way that a portion of the turret 22 overlaps a portion of the turret 52; a feeding unit 3 which serves to deliver blocks or arrays of parallel rod-shaped smokers' products (hereinafter called cigarettes) to a first portion (at 19) of an endless circular path defined by the periphery of the turret 22; a first blank supplying unit 4 serving to deliver to the turret 22 a series of first blanks 31 each of which constitutes a portion of a web consisting of metallic foil; a second blank supplying unit 6 which serves to deliver to the turret 22 a series of prefabricated blanks 92 (one shown in FIG. 2) each of which constitutes a foldable or flexible sheet consisting of paper, cardboard or a synthetic plastic material; a conveyor 7 on which successive cigarette packs 100 are provided with revenue labels 64, and an orientation-changing conveyor 8 which receives labeled cigarette packs 100*a* from the conveyor 7.

The block feeding unit 3 comprises an endless flexible chain or belt conveyor 12 which is trained about sprocket wheels or pulleys 9, 11 and is provided with a set of equidistant pockets 13 for blocks or arrays of cigarettes. The upper reach of the conveyor 12 travels below a stationary magazine 14 which contains a substantial supply of parallel horizontal cigarettes and includes two arraying or block forming devices 16*a*, 16*b* each of which can deliver into the adjacent pocket 13 an array or block consisting of a predetermined number of parallel cigarettes. For example, each block or array can contain twenty cigarettes which form three layers including a top layer of seven cigarettes, an intermediate layer of six cigarettes which are staggered with reference to the cigarettes of the top layer, and a lower layer of seven cigarettes which are staggered with reference to the cigarettes of the intermediate layer. Reference may be had to commonly owned U.S. Pat. No. 4,061,234 granted Dec. 6, 1977 to Jürgen Bantien et al. or to commonly owned U.S. Pat. No. 4,362,235 granted Dec. 7, 1982 to Otto Erdmann. Each of these patents discloses a suitable block forming or arraying device.

The freshly filled pockets 13 of the endless conveyor 12 advance past a monitoring device 17 which is designed to ascertain the number of cigarettes in a block as well as the distribution of cigarettes in successive blocks. An ejecting device 18 is located immediately downstream of the monitoring device 17 and is connected with the latter so that it can eject unsatisfactory (e.g., incomplete or improperly arrayed) blocks of cigarettes from the respective pockets 13.

Pockets 13 which contain satisfactory blocks or arrays of twenty cigarettes each deliver their contents into the pockets 19*a* of a condensing or compacting conveyor 19 arranged to oscillate back and forth through angles of 180° and to deliver successive satisfactory blocks of cigarettes into successive empty hollow mandrels 21 at the periphery of the turret 22 constituting or forming part of the first indexible conveyor 1. The purpose of the conveyor 19 is the same as that of the conveyor 38 shown in FIG. 1*a* of the aforementioned commonly owned U.S. Pat. No. 3,956,870 granted May 18, 1976 to Friedel Kruse et al.

The turret 22 transports the mandrels 21 stepwise from the aforementioned first portion of the endless path which is defined by the periphery of the conveyor 1 toward a second portion where the front sides 21A (See FIG. 2) of successive mandrels are contacted by discrete blanks 31 consisting of metallic foil. Such blanks are supplied by the unit 4 which is mounted in the frame F of the packing machine. The blank supplying unit 4 comprises two horizontal spindles 23*a*, 24*a*, for bobbins or reels 23, 24 of convoluted metallic foil. The expiring bobbin 24 supplies a web 26 of metallic foil into the nip of two advancing rolls 27 which are mounted in the frame F and transport the web 26 lengthwise through an arcuate guide 27*a* and into the range of a severing device 29 comprising a stationary knife and a movable knife. The two knives cooperate to sever the web 26 at regular intervals and to thus form a series of metallic foil blanks 31. An oscillating tongs 28 of the blank supplying unit 4 delivers successive foremost blanks 31 into the spaces between the pairs of neighboring mandrels 21 so that one side of each blank 31 abuts against the front side 21A of the respective mandrel 21, namely, the mandrel which is located immediately therebehind. Each such mandrel 21 contains a block of properly arrayed cigarettes which were delivered into its interior by a pusher (not shown) operating at the transfer station accommodating the compacting conveyor 19 and serving to expel satisfactory blocks of cigarettes from the pockets 19*a* of the conveyor 19 into oncoming empty mandrels 21 of the turret 22.

The blank supplying unit 4 further comprises a suction wheel 26*a*′ which temporarily attracts the leader of a second web 26′ of metallic foil forming the bobbin 23. The leader of the web 26′ is spliced to the trailing end of the web 26 when the supply of metallic foil on the bobbin 24 is exhausted. The means for pivoting the tongs 28 with reference to the frame F, for rotating at least one of the advancing rolls 27, and for moving one of the knives forming part of the severing device 29 is not specifically shown in the drawing. The arrangement is such that the free end portion of the tongs 28 attracts a freshly severed blank 31 by suction and introduces the blank radially into the space between the two neighboring filled mandrels 21 while the turret 22 is at a standstill. The blank 31 which abuts against the front side 21A of the immediately following mandrel 21 is thereupon draped around the respective mandrel by a series of four successive draping, folding and tucking devices 32, 33, 34 and 36 which are adjacent to the path of movement of successive mandrels 21 beyond the tongs 28 of the blank supplying unit 4 and toward the second blank supplying unit 6. The exact construction of the devices 32, 33, 34 and 36 forms no part of the present invention. Reference may be had, for example, to the aforementioned commonly owned U.S. Pat. No. 3,750,676 granted Aug. 7, 1973 to Friedel Kruse et al. The draping, holding and tucking action is such that a mandrel 21 which advances beyond the device 36 is surrounded by the material of the respective blank 31 at five sides but remains accessible at one of its two open ends so that a pusher or the like can enter the accessible open end of the mandrel in order to expel the respective block of cigarettes in a direction toward or away from the observer of FIG. 1*a* and into the registering receptacle 54 of the turret 52 forming part of the second indexible conveyor 2.

Another mode of converting a continuous web of wrapping material into discrete blanks is disclosed in commonly owned U.S. Pat. No. 3,948,020 granted April 6, 1976 to Reinhard Deutsch et al.

The second blank supplying unit 6 is also mounted on the frame F adjacent to the periphery of the turret 22 downstream of the unit 4. The unit 6 comprises a magazine 37 which constitutes a source of prefabricated blanks 92. The underside of the magazine 37 is partially open so as to enable a rotary and reciprocable suction wheel 38 to withdraw successive lowermost blanks 92 and to deliver the leaders of successive blanks into the range of a rotary advancing roll 39. If desired, the magazine 37 of FIG. 1*a* can be replaced with a dual magazine of the type disclosed in commonly owned U.S. Pat. No. 4,132,398 granted Jan. 2, 1979 to Otto Erdmann et al.

The suction wheel 38 cooperates with the advancing roll 39 when it assumes the phantom-line position of FIG. 1*a* to advance the freshly extracted blank 92 toward the periphery of the turret 22. The blank 92 then enters the nip of two advancing rolls 43 which rotate in directions indicated by the arrows and transport the freshly withdrawn blank 92 into the range of a pivotable tongs 44. A suitable paster 41 of the blank supplying unit 6 is adjacent to the left-hand side of the blank 92 advancing with the roll 39 and includes a rotary applicator 42 serving to coat selected portions of the adjacent side of the blank 92 with a suitable adhesive, for example a wet adhesive or a hotmelt. The tongs 44 is pivotable about a horizontal axis and attracts the freshly delivered blank 92 by suction to introduce such blank into the space between the two neighboring mandrels 21 each of which is already substantially confined in an envelope constituting a converted metallic blank 31. The blank 92 which is delivered by the tongs 44 is urged or biased against the front side 21A of the adjacent mandrel 21 (actually against the respective outer surface of the metallic envelope partially surrounding such mandrel) by one of a plurality of biasing members 69 (see also FIG. 2) until such blank reaches the foremost one of four successive draping, folding and tucking devices 47, 48, 49, 51 which convert each blank 92 into an outer envelope surrounding the inner envelope of the respective mandrel 21. The biasing members 69 constitute component parts of discrete holders 46, one for each of the mandrels 21 on the turret 22. The holders 46 are mounted on the turret 22 so that they share the movements of the mandrels 21, and each biasing member 69 is disposed in the space between the two neighboring mandrels 21, namely, in the space between the front side 21A of the mandrel which is located behind the biasing member 69 and the rear side 21B (FIG. 2) of the mandrel 21 which is located immediately in front of the respective biasing member, as considered in the direction of orbital movement of the mandrels 21 at the periphery of the turret 22. In the embodiment which is illustrated in the drawing, the turret 22 is driven to rotate in a counterclockwise direction (see the arrow 22*b* in FIG. 1*a*).

The partially finished cigarette packs which are carried by successive mandrels 21 beyond the folding device 51 downstream of the second blank supplying unit 6 are transferred into successive receptacles 54 at the periphery of the turret 52 at a transfer station 53 where the turret 22 begins to overlap the turret 52. The transfer is effected by a suitable reciprocable pusher which operates in directions at right angles to the plane of FIG. 1*a* so as to enter the open sides or ends of the respective mandrels 21 while such mandrels register with empty receptacles 54. By causing the pusher to enter successive filled mandrels 21, the contents of such mandrels are expelled into the registering receptacles 54 whereby the block which is bodily engaged by the pusher strips the two envelopes (converted blanks 31 and 92) off the respective mandrel 21 and introduces the pack into the respective receptacle 54. The indexible conveyors 1 and 2 are at a standstill during transfer of partially finished cigarette packs from the mandrels 21 into the registering receptacles 54.

The receptacles 54 on the turret 52 transport the partially finished cigarette packs past two stationary folding and tucking stations 56, 57 which are provided with suitable instrumentalities to completely close the inner and outer envelopes at the respective sides of the corresponding packs. This ensures that each pack 100 which is transferred into the oncoming socket or slot 59 of the label applying conveyor 7 constitutes a prismatic body wherein the block of cigarettes is completely surrounded first by the material of the inner envelope (converted metallic blank 31) and also by the material of the outer envelope (converted prefabricated blank 92).

A further transfer unit 58 is provided adjacent to the path of movement of receptacles 54 and serves to transfer successive prismatic packs 100 into the oncoming sockets 59 of the rotary turret-shaped label-applying conveyor 7. The transfer unit 58 is designed to expel packs 100 from selected receptacles 54, to turn each expelled pack through 90°, and to introduce the thus turned pack into the nearest socket 59 of the conveyor 7.

The conveyors 12, 1, 7 and 8 are driven to advance in stepwise fashion, always through one increment corresponding to the spacing between the centers of neighboring pockets 13, mandrels 21, sockets 59 and sockets 66 (of the orientation changing conveyor 8). However, the turret 52 is driven in such a way that each of its intermittent movements entails an advance of each receptacle 54 by two increments, namely, through a distance corresponding to that between the centers of alternate receptacles 54. The reasons for such indexing of the turret 52 are disclosed and claimed in the commonly owned U.S. Pat. No. 3,922,837 granted Dec. 2, 1975 to Harry David. Thus, each partially finished pack on the turret 52 remains in the respective receptacle 54 while the turret 52 performs one revolution and a half so as to ensure that the adhesive which has been applied by the paster 41 sets before a pack 100 is transferred into the neighboring pocket 59 of the conveyor 8. The turret 52 carries an odd number of receptacles 54. The distance between the transfer station 53 and transfer unit 58 equals an odd number of pitches of the conveyor 2, namely, an odd number of distances between the centers of two neighboring receptacles 54.

The conveyor 7 is adjacent to a magazine 61 constituting a source of supply of discrete revenue labels 64. A pivotable withdrawing device 62 is mounted in the frame F adjacent to the bottom portion of the magazine 61 to withdraw successive labels 64 and to deposit the withdrawn labels at the periphery of the conveyor 7 in such a way that each deposited label overlies the open outer end of a socket 59. The labels 64 are attracted to the periphery of the conveyor 7 by suction. Each label 64 at the periphery of the conveyor 7 advances toward the transfer unit 58 and thus into the range of a paster 63 having a rotary roller-shaped applicator 63*a* which coats the exposed side of the label 64 with a suitable adhesive. The withdrawing device 62 operates by suction, the same as the conveyor 7.

When the transfer unit 58 delivers a finished pack 100 from the turret 52 into a socket 59 of the conveyor 7, a portion of such pack is caused to penetrate into the oncoming socket 59 whereby the pack depresses the central portion of the respective adhesive-coated label 64 into the corresponding pocket and converts the label into a U-shaped body which partially overlies and adheres to three sides of the respective pack 100.

The conveyor 7 delivers labeled packs 100 into successive sockets 66 in the periphery of the rotary drum-shaped orientation-changing conveyor 8 which turns each labeled pack 100° through 90° and deposits the freshly turned pack 100*a* on a suitable removing conveyor, not shown. For example, the removing conveyor can deliver the packs 100*a* into the range of a carton filling machine which accumulates predetermined numbers of packs 100*a* into larger groups (each such group can contain ten packs in two layers of five packs each).

Figure 2:
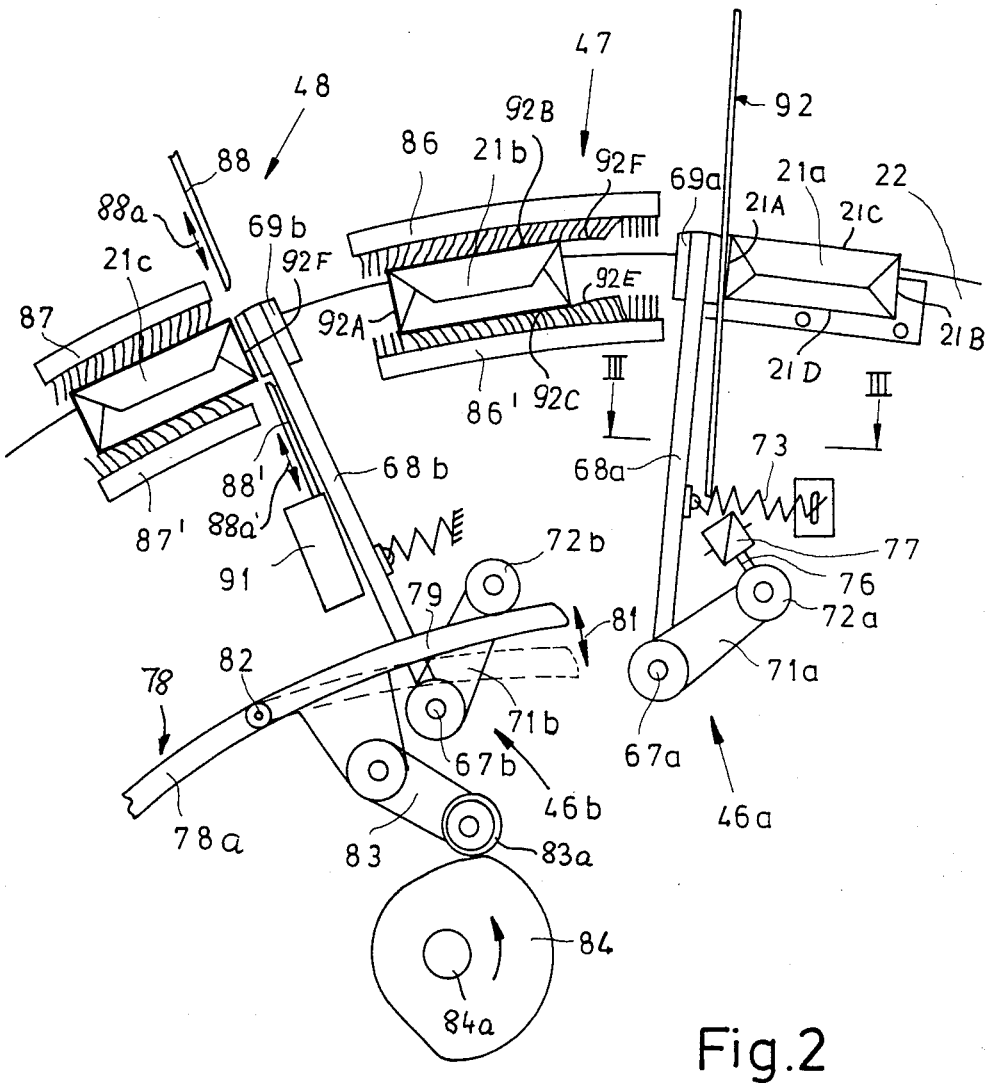
FIG. 2 is an enlarged view of a detail between the radially extending phantom lines A, A in FIG. 1.

Referring now to FIG. 2, there is shown a portion of the turret 22 of the first conveyor 1, together with three successive mandrels 21*a*, 21*b* and 21*c*. FIG. 2 further shows the device 47 and the device 48, namely, the devices which effect partial conversion of successive prefabricated blanks 92 into the outer envelopes of the respective cigarette packs. The exact purpose of the device 47 is to convert each originally flat prefabricated blank 92 into a substantially U-shaped body having a front panel 92A overlying the front side 21A of the respective mandrel 21 (see the mandrel 21*b* of FIG. 2), a second panel 92B which overlies the upper or outer lateral surface 21C of the respective mandrel, and a third panel 92C which overlies the inner lateral surface 21D of the respective mandrel. The rear end portions of the panels 92B and 92C respectively constitute marginal portions 92F, 92E which are thereupon folded against the rear side 21B of the respective mandrel 21 by the reciprocable tools 88, 88′ of the device 48 that follows the device 47. The device 47 comprises two elongated brushes 86, 86′ which serve to fold the panels 92B, 92C against the respective lateral surfaces 21C, 21D of successive mandrels. The device 48 also comprises two brushes 87, 87′ which respectively prevent expansion or unfolding of the panels 92B, 92C while the folding tools 88, 88′ complete the conversion of successive blanks 92 into tubular bodies surrounding the front and rear sides 21A, 21B as well as the two lateral surfaces 21C, 21D of successive mandrels.

Figure 3:
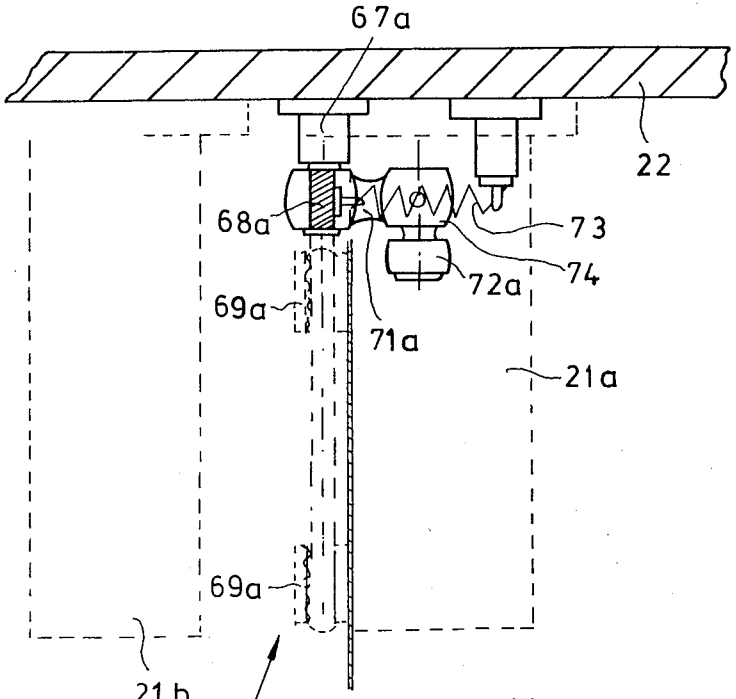
FIG. 3 is a somewhat enlarged sectional view as seen in the direction of arrows from the line III—III of FIG. 2.

As mentioned above, each mandrel 21 which approaches the path portion where it is contacted by the central portion of a freshly supplied prefabricated blank 92 contains a complete block or array of cigarettes. The holder 46*a* of FIG. 2 operates between the spaced-apart mandrels 21*a* and 21*b*, and the holder 46*b* of FIG. 2 operates between the mandrels 21*b*, 21*c*. The holders 46*a*, 46*b* respectively comprise bell crank levers each of which has a substantially radially extending longer arm 68*a*, 68*b* carrying at its outer end the respective biasing member 69*a*, 69*b*, and a shorter arm 71*a*, 71*b* the free end portion of which carries a roller follower 72*a*, 72*b*. The two bell crank levers are respectively mounted on horizontal shafts 67*a*, 67*b* which are carried by the turret 22. The shafts 67*a*, 67*b* are parallel to each other and to the shaft 22*a* for the turret 22. The longer arms 68*a*, 68*b* are biased by discrete coil springs 73 each of which tends to move the corresponding biasing member 69*a*, 69*b* toward the front side 21A of the mandrel (21*a*, 21*b*) which is located behind the respective biasing member, as considered in the (counterclockwise) direction of rotation of the turret 22. The free end portions of shorter arms 71*a*, 71*b* of the respective bell crank levers further support bearings 74 (see FIG. 3) for the roller followers 72*a*, 72*b*. The bearings 74 are connected with the reciprocable armatures 76 of discrete distancing means in the form of electromagnets 77 which are mounted on the turret 22 and can be energized to move the respective biasing members 69*a*, 69*b* to predetermined neutral or median positions substantially midway between the neighboring mandrels 21*a*, 21*b* and 21*b*, 21*c*. The construction of holders 46 for the remaining mandrels 21 on the turret 22 is the same as that of the holders 46*a*, 46*b* shown in FIG. 2. FIG. 3 shows that each biasing member 69 can comprise several spaced-apart pads.

The coil springs 73 constitute means for moving the respective biasing members 69*a*, 69*b* toward the front sides 21A of the neighboring (trailing) mandrels 21*a*, 21*b*. The means for shifting the biasing members 69*a*, 69*b* in the opposite directions, namely, toward the rear sides 21B of the preceding mandrels 21*b*, 21*c*, comprises a stationary arcuate cam 78 having a fixed portion 78*a* which is adjacent to the path of movement of successive holders 46 and has a center of curvature located on the axis of the shaft 22*a* for the turret 22. The rear portion or section 79 of the cam 78 is pivotable (at 82) with reference to the section 78*a* in directions which are indicated by a double-headed arrow 81. The cam section 79 is also of arcuate shape and its curvature is the same as that of the section 78*a*. When the cam section 79 is held in the solid-line position of FIG. 2, it constitutes an extension of the section 78*a* and its center of curvature is also located on the axis of the shaft 22*a*. However when the cam section 79 is moved to the broken-line position of FIG. 2, its center of curvature is not on the axis of the shaft 22*a* and, in such position, the cam section 79 enables successive roller followers 72 to travel along its outer side toward, onto and along the outer side of the stationary cam section 78. The arrangement is such that a biasing member (69*b* in FIG. 2) which is outwardly adjacent to the cam section 79 is moved away from the front side 21A of the trailing mandrel 21*b* and toward the rear side 21B of the preceding mandrel 21*c* when the cam section 79 is pivoted from the broken-line position to the solid-line position of FIG. 2 while the turret 22 is at a standstill. The means for moving the cam section 79 between such positions includes a bell crank lever 83 which is secured to the underside of the section 79 and has a roller follower 83*a* tracking the periphery of a rotary disc cam 84. The shaft 84*a* of the cam 84 is intermittently driven by the main prime mover 101 (see FIG. 1*a*) of the packing machine.

The outer folding tool 88 of the device 48 shown in FIG. 2 is reciprocable in the directions indicated by a double-headed arrow 88*a* by a collapsable lever 89 which is illustrated in FIG. 1*a*. The folding tool 88′ of the device 48 is reciprocable in directions indicated by the double-headed arrow 88*a*′ by a motor 91 which is mounted adjacent to the path of movement of the turret 22. The motor 91 can be replaced by other suitable means for transmitting motion to the folding tool 88′ in synchronism with movements of the folding tool 88 so as to complete the conversion of successive blanks 92 into tubular bodies surrounding the sides 21A, 21B and the lateral surfaces 21C, 21D of the respective mandrels 21.

The operation of the packing machine is as follows:

The mode of operation of all parts preceding the blank supplying unit 6 is the same as described in the aforementioned commonly owned U.S. Pat. No. 3,956,870. The pivotable tongs 44 delivers a fresh blank 92 from the nip of the advancing rolls 43 during each interval of idleness of the turret 22. The freshly delivered prefabricated blank 92 assumes the position which is shown in the right-hand portion of FIG. 2, namely, the central portion of the right-hand side of such blank is adjacent to the front side 21A of the mandrel 21*a*. It will be noted that the blank 92 extends substantially radially of the turret 22. The tongs 44 thereupon releases the blank 92 and pivots clockwise, as viewed in FIG. 1*a*, so as to engage the leader of the next-following blank.

During delivery of a fresh prefabricated blank 92 into the space between the mandrels 21*a*, 21*b*, the electromagnet 77 for the bell crank lever of the holder 46*a* is energized by a suitable monitoring device (e.g., in response to stoppage of the turret 22) to attract the armature 76 and to thereby maintain the longer arm 68*a* and the corresponding biasing member 69*a* in a neutral position substantially midway between the front side 21A of the mandrel 21*a* and the rear side 21B of the mandrel 21*b*. This provides room for insertion of the blank 92 into the space between the biasing member 69*a* and the mandrel 21*a*. The magnet 77 for the holder 46*a* is deenergized (e.g., with a predetermined delay) as soon as the blank 92 assumes the position which is shown in the right-hand portion of FIG. 2 whereby the coil spring 73 is free to contract and to pivot the longer arm 68*a* about the axis of the shaft 67*a* so that the biasing member 69*a* is pivoted in a clockwise direction and engages the left-hand side of the blank 92 opposite the front side 21A of the mandrel 21*a*. The biasing member 69*a* then holds the blank 92 in the illustrated position during the next-following indexing of the turret 22 in a counterclockwise direction, as indicated by the arrow 22*b*. This moves the arm 68*a* and the mandrel 21*a* into the space between the bristles of the stationary brushes 86, 86' forming part of the device 47. The bristles yield to a certain extent but their stiffness suffices to neatly fold the panels 92B, 92C of the blank 92 over the respective lateral surfaces 21C, 21D of the mandrel 21*a* which then assumes the position corresponding to that of the mandrel 21*b* shown in the central portion of FIG. 2. Thus, the originally flat blank 92 is converted into a U-shaped body which overlies the front side 21A and the lateral surfaces 21C, 21D of the mandrel occupying the position of the mandrel 21*b* shown in FIG. 2. The rear side 21B of the mandrel 21*b* remains exposed because the marginal portions 92E, 92F of the blank 92 in the region of the device 47 are still spaced apart from one another.

The turret 22 is then indexed again in a counterclockwise direction whereby the mandrel 21*a* moves from the position occupied in FIG. 2 by the mandrel 21*b* to that which is occupied by the mandrel 21*c*. The biasing member 69*a* is then located to the left of the panel 92A on the mandrel 21*c* between the brushes 87, 87' of the device 48. The purpose of the brushes 87, 87' is to prevent the panels 92B, 92C from moving away from the respective lateral surfaces 21C, 21D of the mandrel occupying the position of the mandrel 21*c* shown in FIG. 2. In the next step, the folding tool 88' is actuated by its motor 91 to perform an upward stroke, as viewed in FIG. 2, and to fold the marginal portion 92E over the rear side 21B of the mandrel occupying the position 21*c*. The folding tool 88' is thereupon retracted to the position which is shown in FIG. 2, and such retraction is followed by downward movement of the folding tool 88 which folds the marginal portion 92F over the already folded marginal portion 92E to complete the conversion of the originally flat prefabricated blank 92 into a tubular body which surrounds the sides 21A, 21B and the lateral surfaces 21C, 21D of the mandrel occupying the position 21*c*. The inner side of the marginal portion 92F and/or the outer side of the marginal portion 92E is coated with adhesive (by the applicator 42 of the paster 41 shown in FIG. 1*a*) so that the marginal portion 92F tends to adhere to the outer side of the folded marginal portion 92E. The folding tool 88 is thereupon retracted to the position which is shown in FIG. 2 and the motor 101 rotates the disc cam 84 through an angle which is necessary to effect a pivoting of the cam section 79 from the broken-line position to the solid-line position of FIG. 2 whereby the roller follower 72*b* of the holder 46*b* causes the longer arm 68*b* to shift the biasing member 69*b* against the outer side of the folded-over marginal portion 92F of the blank at the station between the brushes 87 and 87'. The biasing member 69*b* is urged against the folded-over marginal portion 92F with sufficient force to ensure that such marginal portion is not lifted off the adjacent marginal portion 92E during further stepwise advance of the respective mandrel (21*c*) toward the transfer station 53 between the conveyors 1 and 2. During such further movement, the devices 49 and 51 complete the folding of flaps at the side of the mandrel 21*c* facing the observer of FIG. 1*a* or FIG. 2, or at the opposite side, so as to ensure that one end of each mandrel remains open for expulsion of the partially completed pack in a manner as described above. The curvature of the longer section 78*a* of the stationary cam 78 is such that the biasing member 69*b* continues to bear against the marginal portion 92F during movement of the roller follower 72*b* toward the transfer unit 53. This provides ample time for setting of the adhesive which bonds the marginal portions 92E, 92F to each other. In the embodiment which is shown in FIG. 2, the folding devices 49, 51 complete the folding of those portions of the panels 92A, 92B, 92C and of the marginal portions 92E, 92F which extend from the plane of FIG. 2 toward the observer. This is due to the fact that, as shown in FIG. 2, the corresponding metallic blanks 31 are converted into partially closed envelopes which have flaps and tucks facing the observer of FIG. 2. The other ends of the packs are closed at the stations 56, 57 which are adjacent to the receptacles 54 on the turret 52 of the conveyor 2.

The biasing members 69 perferably also serve to hold the metallic blanks 31 against movement relative to the front sides 21A of the respective mandrels 21 prior to folding of such blanks about the mandrels. However, it is not absolutely necessary to move the biasing members 69 against the overlapping marginal portions of the blanks 31 at the rear sides 21B of the preceding mandrels 21 because the blanks 31 consist of a metallic material and thus exhibit little or no tendency to open up during movement beyond the device 36. The magnets 77 are energized to move the respective biasing members 69 to neutral positions immediately before the mandrels 21 behind such biasing members reach the tongs 28, i.e., before the front sides 21A of mandrels are contacted by the freshly delivered blanks 31.

An important advantage of the improved holders 46 is their simplicity. Thus, the biasing member 69 of each holder 46 can perform two functions, namely, that of holding a blank 92 against movement relative to the mandrel (21*a* in FIG. 2) that is located immediately behind such biasing member, and that of thereupon preventing the opening of tubular bodies which are obtained by partial conversion of successive blanks 92 into envelopes surrounding the corresponding metallic envelopes on the respective mandrels 21. Another important advantage of the improved packing machine is that the number of rejects is reduced to a fraction of the number of rejects which can be expected during operation of a conventional packing machine. This is due to the fact that the marginal portions 92F of successive outer envelopes are held against movement away from the adjacent marginal portions 92E even if the material of the blanks 92 is relatively stiff and exhibits a pronounced tendency to reassume its original shape.

A further important advantage of the improved packing machine is its simplicity. Thus, the holders 46 occupy little room because their biasing members 69 are designed to carry out the aforediscussed dual functions. The distance between the folding device 48 and the transfer unit 53 suffices to ensure that the adhesive between the marginal portions 92F, 92E of successive blanks 92 sets before the respective packs are transferred into the registering receptacles 54 of the turret 52.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. In a packing machine for arrays of cigarettes or other articles of the tobacco processing industry, the combination of a conveyor having a series of spaced-apart hollow mandrels arranged to advance in a predetermined direction along a predetermined path, each of said mandrels having a front side and a rear side, as considered in said direction; means for introducing arrays of articles into successive mandrels in a first portion of said path; a source of foldable blanks; means for supplying blanks from said source into spaces between successive mandrels in a second portion of said path downstream of said first portion; means for draping the thus supplied blanks about the mandrels which follow the supplied blanks so that each draped blank includes a pair of overlapping marginal portions at the rear side of the respective mandrel; and means for holding the blanks against the mandrels, including biasing members disposed between successive mandrels of said series and arranged to share the movement of said conveyor, means for moving successive biasing members against the freshly supplied blanks at the front sides of the mandrels following the respective biasing members in a third portion of said path downstream of said second portion, and means for shifting successive biasing members against the overlapping marginal portions of draped blanks at the rear sides of the preceding mandrels in a fourth portion of said path downstream of said third portion, one of said moving and shifting means comprising a stationary cam and said holding means further comprising a lever for each of said biasing means, said levers being pivotally mounted on said conveyor and having follower means arranged to track said cam, said cam including a first section arranged to maintain said biasing members in engagement with the folded marginal portions of blanks at the rear sides of the respective mandrels in said fourth portion of said path, and a second section movable between first and second positions in the region between the third and fourth portions of said path to thereby shift successive biasing members from engagement with the blanks at the front sides of the adjacent upstream mandrels into engagements with the folded marginal portions of blanks at the rear sides of the adjacent downstream mandrels.

2. The combination of claim 1, wherein each of said mandrels further comprises lateral surfaces extending between the respective front and rear sides, said draping means including means for folding the blanks first around the lateral surfaces of the respective mandrels and means for thereupon folding the marginal portions of the blanks over the rear sides of the respective mandrels.

3. The combination of claim 1, wherein said moving means comprises resilient means for yieldably urging said biasing members toward the front sides of the neighboring mandrels.

4. The combination of claim 1, further comprising distancing means for maintaining said biasing members out of contact with the front sides of adjacent mandrels in said second portion of said path.

5. The combination of claim 1, further comprising distancing means for maintaining said biasing members out of contact with the neighboring mandrels in said second portion of said path.

6. The combination of claim 5, wherein said draping means comprises first folding means for folding the blanks relative to the front sides of the respective mandrels in said third portion of said path and second folding means for folding the marginal portions of successive blanks over the rear sides of the respective mandrels between the third and fourth portions of said path.

7. The combination of claim 1, wherein each of said levers comprises a first arm carrying the respective biasing member and a second arm provided with the respective follower means.

8. The combination of claim 7, wherein each of said levers is a bell crank lever.

9. The combination of claim 1, wherein said conveyor is rotatable about a predetermined axis and said first section of said cam has an arcuate shape with a center of curvature on said axis.

10. The combination of claim 9, wherein said second section of said cam has an arcuate shape with a radius of curvature corresponding to that of said first section, the center of curvature of said second section of said cam being located on said axis in the second position of said second section.

11. The combination of claim 1, further comprising drive means for pivoting the second section of said cam between said first and second positions.

12. The combination of claim 11, wherein said drive means comprises a rotary cam and further comprising motor means arranged to drive said conveyor and to rotate said rotary cam.

13. The combination of claim 1, further comprising a second source of different second blanks, means for supplying second blanks from the respective source between successive mandrels in a fifth portion of said path upstream of said second portion, and means for draping the second blanks about the mandrels therebehind between the fifth and second portions of said path.

14. The combination of claim 1, further comprising means for coating selected portions of said blanks with adhesive intermediate said source and said second portion of said path.

15. In a packing machine for arrays of cigarettes or other articles of the tobacco processing industry, the combination of a conveyor having a series of spaced-apart hollow mandrels arranged to advance in a predetermined direction along a predetermined path, each of said mandrels having a front side and a rear side, as considered in said direction; means for introducing arrays of articles into successive mandrels in a first portion of said path; a source of foldable blanks; means for supplying blanks from said source into spaces between successive mandrels in a second portion of said path downstream of said first portion; means for draping the thus supplied blanks about the mandrels which follow the supplied blanks so that each draped blank includes a pair of overlapping marginal portions at the rear side of the respective mandrel; means for holding the blanks against the mandrels, including biasing members disposed between successive mandrels of said series and arranged to share the movement of said conveyor, means for moving successive biasing members against the freshly supplied blanks at the front sides of the mandrels following the respective biasing members in a third portion of said path downstream of said second portion, and means for shifting successive biasing members against the overlapping marginal portions of draped blanks at the rear sides of the preceding mandrels in a fourth portion of said path downstream of said third portion; and distancing means for maintaining said biasing members out of contact with the front sides of the adjacent mandrels in the second portion of said path, said distancing means comprising a magnet for each of said biasing members and means for movably coupling said biasing members with the respective magnets.

16. The combination of claim 15, wherein each of said magnets is an electromagnet.

* * * * *